United States Patent [19]

Plapp

[11] Patent Number: 5,050,560

[45] Date of Patent: Sep. 24, 1991

[54] SETTING SYSTEM (OPEN-LOOP AND/OR CLOSED-LOOP CONTROL SYSTEM) FOR MOTOR VEHICLES

[75] Inventor: Güter Plapp, Filderstadt, Fed. Rep. of Germany

[73] Assignee: Robert Bosch GmbH, Stuttgart, Fed. Rep. of Germany

[21] Appl. No.: 490,666

[22] PCT Filed: Aug. 5, 1988

[86] PCT No.: PCT/DE88/00483

§ 371 Date: Mar. 5, 1990

§ 102(e) Date: Mar. 5, 1990

[87] PCT Pub. No.: WO89/02030

PCT Pub. Date: Mar. 9, 1989

[30] Foreign Application Priority Data

Sep. 4, 1987 [DE] Fed. Rep. of Germany ..... 3729635

[51] Int. Cl.[5] ..... F02D 41/14

[52] U.S. Cl. ..... 123/488; 123/489; 123/494

[58] Field of Search ..... 123/478, 480, 488, 489, 123/494; 73/3, 118.2

[56] References Cited

U.S. PATENT DOCUMENTS

| | | | |
|---|---|---|---|
| 4,562,814 | 1/1986 | Abo et al. | 123/488 |
| 4,594,987 | 6/1986 | Wataya et al. | 123/494 |
| 4,644,474 | 2/1987 | Aposchanski et al. | 123/494 X |
| 4,712,529 | 12/1987 | Terasaka et al. | 123/492 |
| 4,986,244 | 1/1991 | Kobayashi et al. | 123/488 |

FOREIGN PATENT DOCUMENTS

| | | |
|---|---|---|
| 3700766 | 7/1987 | Fed. Rep. of Germany . |
| 61-58945 | 3/1986 | Japan . |

*Primary Examiner*—Willis R. Wolfe

*Attorney, Agent, or Firm*—Walter Ottesen

[57] ABSTRACT

A setting system (14) for setting the quantity of fuel delivered to an internal combustion engine has a first setting unit (10.1.1) and a second control unit (10.2.1). The first control unit emits, as a function of signals which are supplied to it from a first sensor arrangement (11.1), a first manipulated variable to the fuel injection pump (12.1). The second setting unit determines, as a function of signals from a second sensor arrangement (11.2), a second manipulated variable, which likewise would be directly suitable for actuating the fuel injection pump, but which is used to calibrate the first setting unit. The setting system thus set up is used whenever a sensor arrangement is used as second sensor arrangement which is slower, but measures more accurately than the first sensor arrangement. Then, the second manipulated variable corresponds more accurately to a value necessary for achieving a desired lambda value than the first manipulated variable. In turn, the first manipulated variable responds more quickly to changes in the air mass delivered to the internal combustion engine. As a result of the first control unit being calibrated with the aid of the second manipulated variable, the first manipulated variable is influenced with greater accuracy than was previously possible, but as before with high speed.

5 Claims, 2 Drawing Sheets

SETTING SYSTEM (OPEN-LOOP AND/OR CLOSED-LOOP CONTROL SYSTEM) FOR MOTOR VEHICLES

FIELD OF THE INVENTION

The invention relates to a setting system for variables to be monitored in motor vehicles. The term "setting system" is used here as a collective term for "open-loop control system" and "closed-loop control system". Accordingly, the term "setting unit" is used as a collective term for "open-loop control unit" and "closed-loop control unit" and the term "set system" is used for "open-loop controlled system" and "closed-loop controlled system". The term "unit" is basically to be understood in the sense of a functional unit. An open-loop control unit and a closed-loop control unit thus need not be separate modules, instead they may be realized, as is presently customary in automotive engineering, by functions of a microprocessor.

The invention relates in particular to the setting of the quantity of fuel metered to an internal combustion engine in such a way that a desired lambda value is achieved as accurately as possible.

BACKGROUND OF THE INVENTION

The prior art is how using FIG. 1, which is an exemplary embodiment for a fuel quantity setting arrangement, as is known from DE-C2-24 57 436.

In the known arrangement, the setting system consists of a single setting unit, which is designed as a combined open-loop/closed-loop control unit. This open-loop/closed-loop control unit is supplied signals from a sensor arrangement 11, that is the signal of a speed sensor and the signal of a throttle-flap sensor. From these signals, the air volume taken in by the engine corresponding thereto can be determined. From this air volume, the open-loop/closed-loop control unit computes a corresponding quantity of fuel and determines the value of a manipulated variable, which is supplied to a fuel injection pump 12. The manipulated variable is predetermined from a throttle-flap/speed characteristic map and modified by a multiplicative factor, which depends on the difference between a lambda desired value fixed for the closed-loop control unit and a lambda actual value, as is emitted by a lambda probe 13, acting as output sensor, to the controlling setting unit 10.

This is consequently an open-loop control with subsequent closed-loop control, by which the value of the manipulated variable follows the value of the signals emitted by the speed sensor and by the throttle-flap sensor. The open-loop control has a very fast response performance, since a change in the signals of the speed sensor and/or of the throttle-flap sensor is converted directly into a changed manipulated variable. However, whether this fast conversion was correct only becomes apparent when the lambda probe 13 reports back the new lambda actual value. This happens with a transient response period of about half a second to several seconds. If, due to the measurement of the lambda probe arrangement, a deviation between lambda desired value and lambda actual value is established, the multiplicative factor for calculating the manipulated variable is determined anew by the controlling part of the setting unit 10.

In the known arrangement, there exists for example the problem that, with the aid of the speed sensor and the throttle-flap sensor, the air volume is determined, but not the air mass, which is actually what is important for the metering of the quantity of fuel. Therefore, in the prior art, air-mass sensors in the form of hot-wire air-mass sensors or hot-film air-mass sensors are used as sensor arrangements. These allow quite an accurate determination of the air mass.

The advantage of air-mass sensors with respect to the measuring accuracy of the variable which is actually to be monitored is, however, also offset by disadvantages. Although hot-film air-mass sensors can be produced cheaply and robustly, they then operate relatively slowly.

U.S. Pat. No. 4,712,529 is cited as further state of the art. This publication relates to an "air/fuel-ratio control arrangement for transition conditions during operation of an internal combustion engine". The metered fuel quantity is here determined in dependence upon the air throughput in the intake pipe. However, because air mass measuring arrangements exhibit an inertia caused by physical conditions, measures are taken for making ready a quickest possible effective acceleration enrichment. For this purpose, especially the output signal of a throttle-flap position sensor serves which acts in a corrective manner on the basic fuel metering signal dependent upon the air throughput. With this state of the art, the premise is taken that the fuel metering signal is formed from the air mass throughput signal and a signal from the throttle flap position sensor acts correctively.

In addition, a fuel metering system is known from US-A-4 594 987 wherein, corresponding to FIG. 9, likewise the throttle flap position signal is applied to form a corrective variable.

Finally, JP-A-61 58 945 disclosed a safety system in combination with the fuel metering in an internal combustion engine such that the output signals of two sensors, which respond to the air throughput in the intake pipe, are compared with each other and a malfunction determination is made possible in correspondence to the results.

SUMMARY OF THE INVENTION

The invention is based on the object of providing a setting system which sets faster and more accurately than the system mentioned in the beginning.

A setting system according to the invention does not only have a single setting unit, as in the case of the prior art, but two setting units. With this arrangement, the first setting unit emits the actuating signal to the set system, while the second setting unit serves the purpose of calibrating the first setting unit. The second setting unit is provided for the interconnecting with a second sensor arrangement, which measures more slowly, but more accurately than a first sensor arrangement, which is interconnected with the first setting unit. As a result, the first setting unit can respond very quickly to changes, as they are reported by the first sensor arrangement. The first manipulated variable, quickly determined in this way, is compared with a second manipulated variable, determined more slowly but more accurately by the second control unit. If a deviation is established, the first manipulated variable is changed such that the deviation moves in the direction of zero. As a result, the overall system can respond quickly and nevertheless accurately to changes in the input variables. If the first manipulated variable is also to be fixed as a function of an output variable, one of the two setting units is supplied the signal from an output sensor.

According to a preferred embodiment, the first setting unit is a control unit, which receives signals from a speed sensor and a throttle-flap sensor, in order to determine therefrom an air volume, therefrom an air mass and therefrom in turn a first manipulated variable, which fixes the quantity of fuel which is to be added to the air mass in order to obtain a desired lambda value. The second setting unit is likewise a control unit, which is however supplied the signal from a hot-film air-mass sensor, which makes possible a more accurate determination of the air mass than is possible from speed and throttle-flap position. However, the time response of this second sensor arrangement is slower than that of the first sensor arrangement, as described above. From the signal of the hot-film air-mass sensor, the second control unit determines a second manipulated variable, which represents a measurement for the quantity of fuel. This manipulated variable is, however, not supplied to the fuel injection pump; instead, as described above for the general case, it is used for calibrating the first setting unit.

The calibration values may be stored differently for different operating points, for example in a characteristic map. In this way, there is separate compensation for deviations dependent upon operating point.

Each of the two control units according to the embodiment just described may be designed as an open-loop/closed-loop control unit to which the signal from a lambda sensor is supplied. Which of the two control units is designed as an open-loop/closed-loop control unit depends essentially on the time response of the associated open-loop/closed-loop control circuit in the particular case. The arrangement is designed such that the risk of hunting is as small as possible.

BRIEF DESCRIPTION OF THE DRAWINGS

Embodiments of the invention are illustrated in the drawing and explained in more detail in the following description.

DESCRIPTION OF THE PREFERRED EMBODIMENTS OF THE INVENTION

Figure 1:
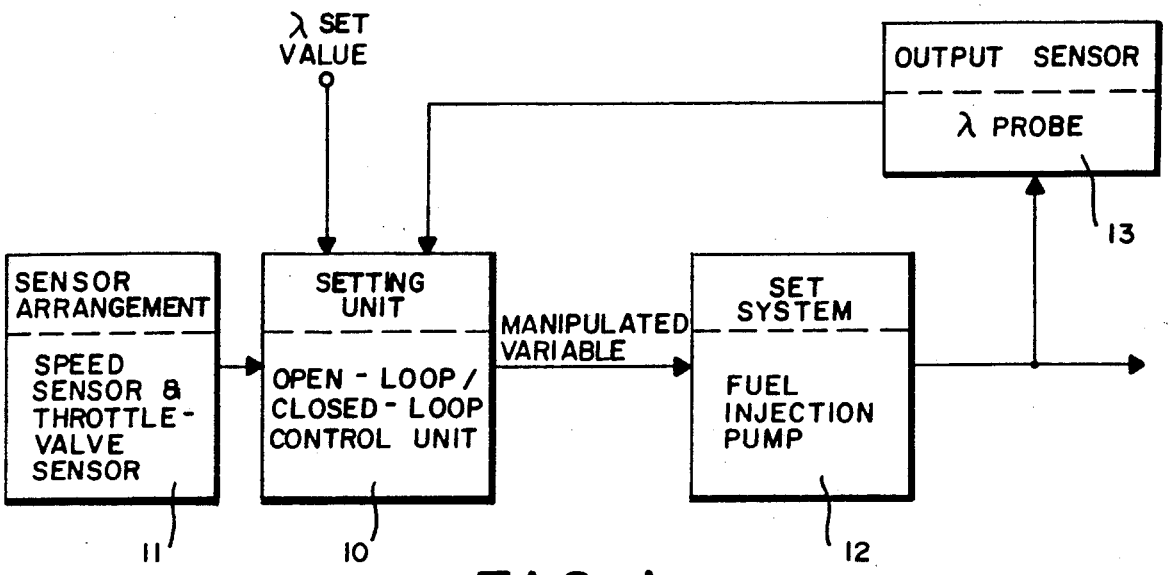
FIG. 1 PRIOR ART
FIG. 1 shows a block circuit diagram of a known setting arrangement for the setting of the quantity of fuel delivered to a motor vehicle engine.
Figure 2:
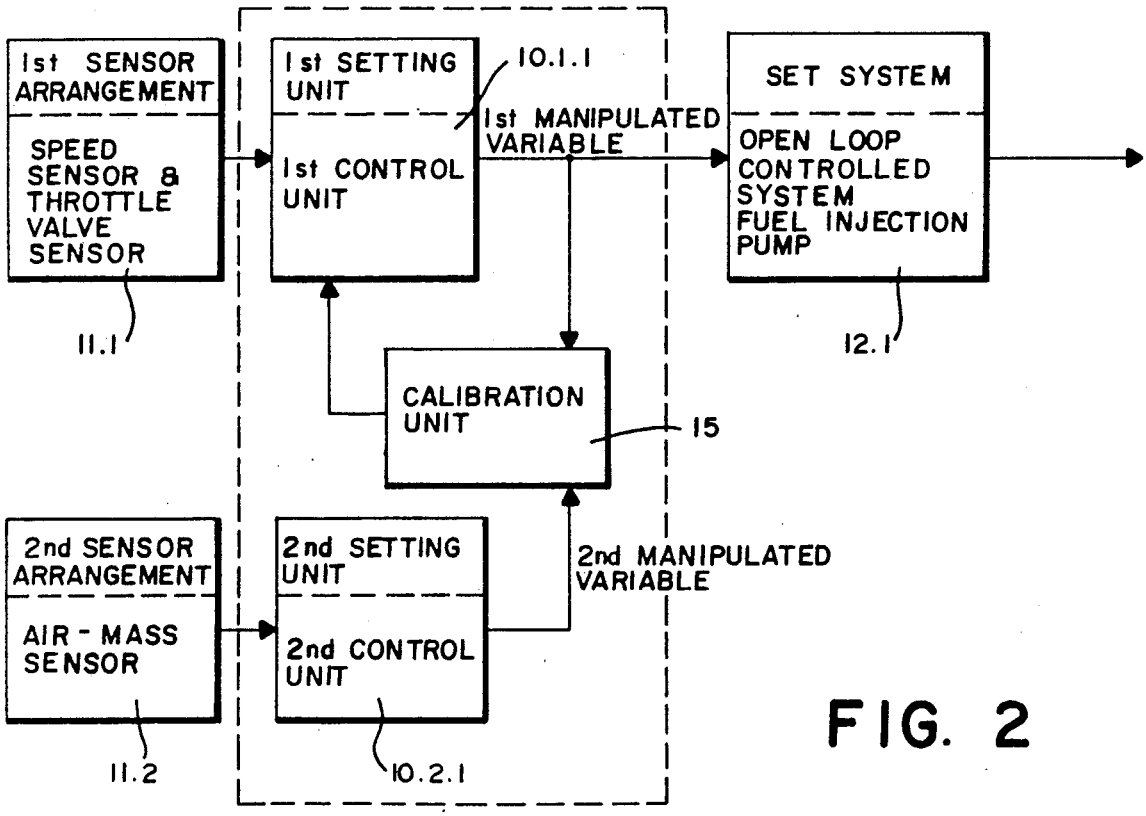
FIG. 2 shows a block circuit diagram of a setting arrangement with a setting system according to the invention with two setting units.

The setting arrangement according to FIG. 2 has a setting system 14, which is supplied signals from a first sensor arrangement 11.1 and a second sensor arrangement 11.2, and which emits a first manipulated variable to a setting system 12.1. The setting system 14 is configured as a microprocessor system, with the following functional units: a first setting unit, which is configured as a first control unit 10.1.1; a second setting unit, which is configured as a second control unit 10.2.1; and, a calibration unit 15.

The first control unit 10.1.1 receives from the first sensor arrangement 11.1 at least one reference variable. According to a preferred configuration of the first embodiment according to FIG. 2, the first sensor arrangement 11.1 emits signals from a speed sensor and from a throttle-flap sensor. From these signals, the first control unit 10.1.1 computes the first manipulated variable, which in the mentioned configuration is the signal which is delivered to a fuel injection pump as setting system 12.1. The computation of the first manipulated variable is performed either via a speed sensor/throttle-flap sensor/manipulated variable characteristic map or by an air volume being determined from the signals from the speed sensor and from the throttle-flap sensor. An air mass is determined from the air volume, from which, in turn, a quantity of fuel is determined and from this quantity of fuel, the first manipulated variable is determined.

The second control unit 10.2.1 receives an input signal from the second sensor arrangement 11.2, which in the mentioned configuration is formed as an air-mass sensor. This air-mass sensor determines much more accurately the air mass taken in by an internal combustion engine than is possible by determining the air mass from the measurement of speed and throttle-flap position with the aid of the first sensor arrangement 11.1. However, the air-mass sensor according to the second sensor arrangement 11.2 measures more slowly than the first sensor arrangement 11.1. This sensor signal, which is accurate but assumes the new value only slowly when there is a change in the air mass taken in, is converted by the second control unit 10.2.1 into a second manipulated variable, which, identically to the first manipulated variable, is a signal. This signal is suitable for setting a fuel injection pump such that the latter accurately discharges the quantity of fuel which is to be added to the determined air mass in order to obtain a desired lambda value in combustion. This second manipulated variable is not, however, delivered to the setting system 12.1, designed as a fuel injection pump, but to the calibration unit 15. The latter realizes (generally by way of computer technology) the functions of a comparator, a signal converter and a sample/hold-circuit. The calibration unit 15 establishes whether the first manipulated variable, which was determined on the basis of signals from the less accurate first sensor arrangement, deviates from the more accurate second manipulated variable. The calibration unit 15 also determines whether the first manipulated variable remained within a given time span in a time period which corresponds at least to the transient response of the second sensor arrangement 11.2. If this is the case, it is determined that a condition existed which was virtually steady-state for the second sensor arrangement 11.2. Within this condition the slow second sensor arrangement could assume an accurate indicating value after a sudden change in the quantity of air taken in.

If such a virtually steady-state condition exists, the differential signal from first manipulated variable and second manipulated variable or a signal converted to the differential signal is emitted via the sample/hold-function to the first control unit 10.1.1. If, thereafter, the first manipulated variable varies within the given time span by more than corresponds to the pregiven percentage frame, the sample/hold-function holds the value which was outputted last, when still virtually steady-state conditions prevailed.

The value outputted by the calibration unit 15 influences the first control unit 10.1.1 such that the latter changes the first manipulated variable in a direction that the value of the first manipulated variable is adapted to the value of the second manipulated variable. If, for example, a deviation of the value of the first manipulated variable from the value of the second manipulated variable by two percent is established by the calibration unit 15, the first control unit 10.1.1 multiplies the previously emitted value of the first manipulated variable by the factor 1.02.

The setting system 14 functioning in such a way has the effect that the first manipulated variable is fixed almost during the entire operating time of the arrangement according to FIG. 2 with an accuracy which corresponds to the high measuring accuracy of the second sensor arrangement. However, when there are changes in the input variables, the system changes at the high follow-up rate which corresponds to the setting rate of the first sensor arrangement.

In the previously described embodiments and designs of the same, the setting system had a first control unit 10.1.1 and a second control unit 10.2.1. However, instead of simple open-loop control units, open-loop/-closed-loop control units can also be used, for example an open-loop/closed-loop control unit 10.1.2 for the emission of the first manipulated variable, as represented in the setting arrangement according to FIG. 3, or an open-loop/closed-loop control unit 10.2.2 for the emission of the second manipulated variable, as illustrated in the arrangement according to FIG. 4. The use of open-loop/closed-loop control units instead of open-loop control units has the advantage that it is monitored whether the output variable influenced by the manipulated variable actually assumed the desired set value, or whether deviations exist which are to be corrected.

Figure 3:
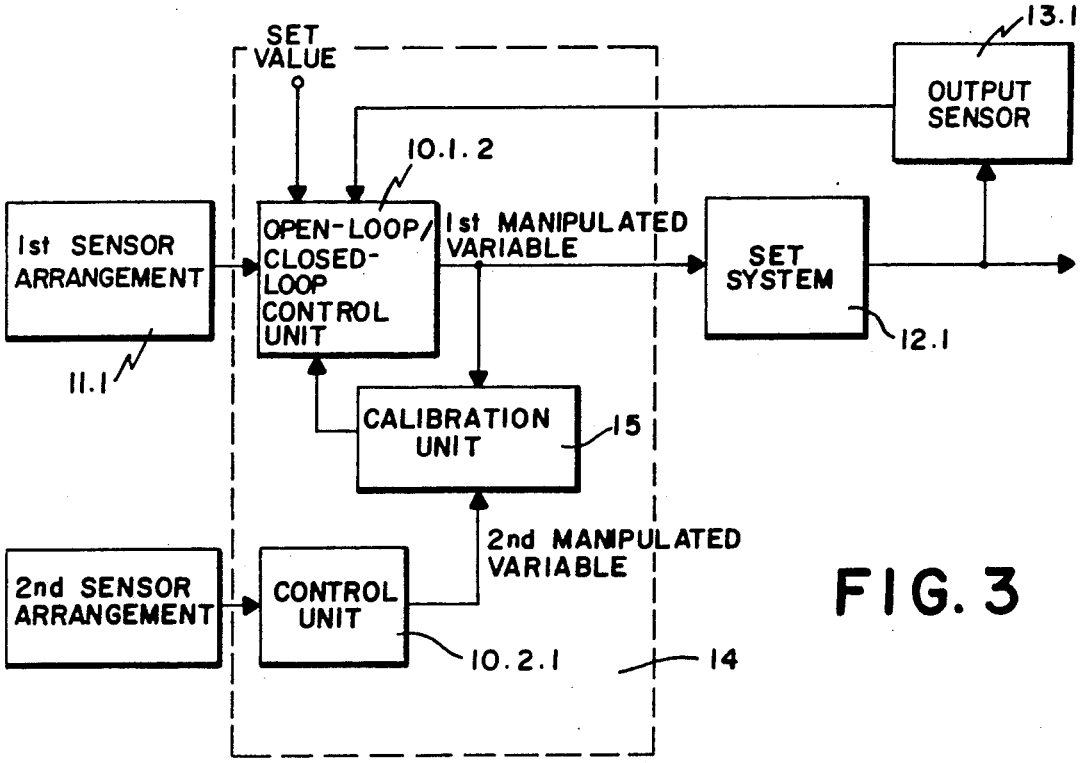
FIGS. 3 and 4 each show a block circuit diagram of setting arrangements with one setting system, each with a closed-loop control unit and an open-loop control unit.

The arrangement according to FIG. 3 differs from that according to FIG. 2 in that there is additionally an output sensor 13.1, which measures the output variable of the set system 12.1 or a variable dependent thereon. The output sensor 13.1 emits its output signal to the already mentioned open-loop/closed-loop control unit 10.1.2, which replaces the control unit 10.1.1. The open-loop/closed-loop control unit 10.1.2 carries out a closed-loop control on a value dependent on the output signal of the first sensor arrangement 11.1. In this closed-loop control, the output signal from the output sensor 13.1 is compared with a set value which is supplied to the open-loop/closed-loop control unit 10.1.2. If the setting arrangement according to FIG. 4 with the embodiment of a setting system 14 just described has a design which corresponds to the design of the arrangement according to FIG. 2, it is of advantage to configure the output sensor as a lambda probe. The complete arrangement then functions like the arrangement according to FIG. 2, but taking into account the closed-loop control function described above.

Figure 4:
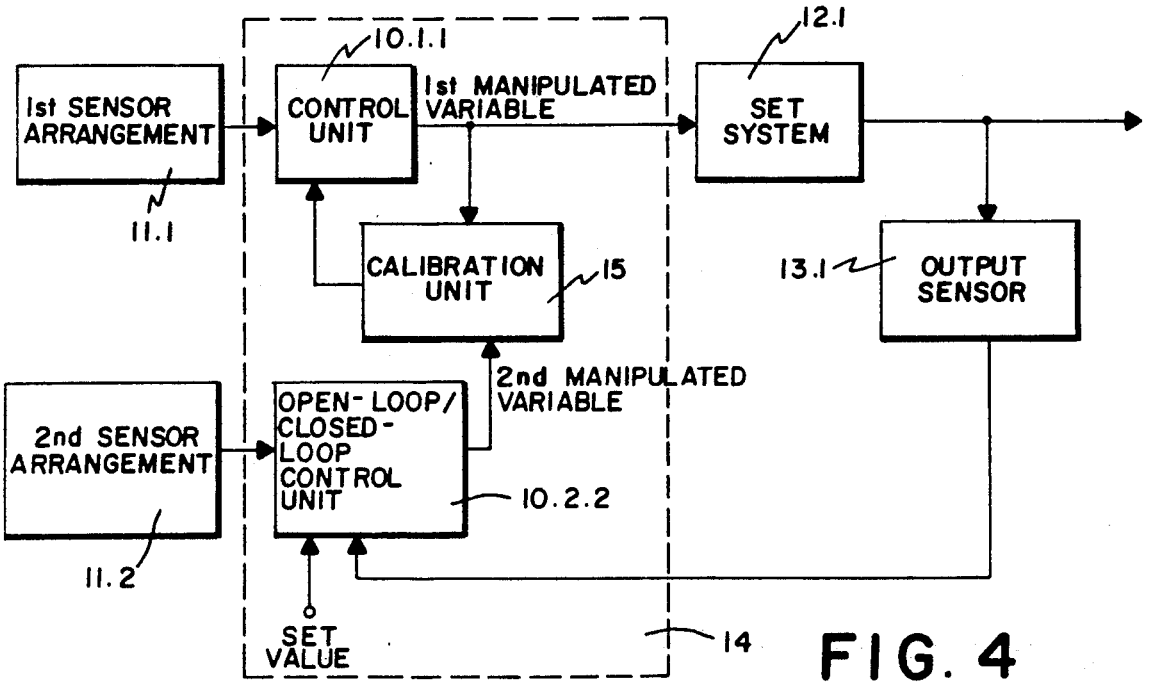

In the case of the setting arrangement according to FIG. 4, the output sensor 13.1, described with reference to the arrangement according to FIG. 3, emits its output signal to the open-loop/closed-loop control unit 10.2.2, already mentioned above. This open-loop/closed-loop control unit, based on the embodiment according to FIG. 2, replaces the second control unit 10.2.1. The second open-loop/closed-loop control unit 10.2.2 is at the same time supplied a set value. By means of this arrangement, the control unit 10.1.1 no longer receives an open-loop controlled calibration value for the outputting of the first manipulated variable but a closed-loop controlled calibration value. As a result, the first manipulated variable also has closed-loop control character, although it is controlled by the control unit 10.1.1 merely as a function of values as they are measured by the first sensor arrangement 11.1.

The question as to when it is more advantageous to use closed-loop control for controlling the first setting unit and when it is more advantageous to use closed-loop control for controlling the second setting unit depends essentially on the time response of the sensors used in the complete arrangement. Closed-loop control is chosen in the branch which has less of a hunting tendency in its time response.

I claim:

1. A setting system for a control variable in an internal combustion engine of a motor vehicle, the setting system comprising:

a plurality of sensors for providing signals indicative of operating characteristic variables such as rotational speed and throttle-flap position;

a first setting unit for providing a first signal in dependence upon a first group of said sensors;

a second setting unit for processing at least a signal of a further one of said sensors and providing a second signal;

calibrating means for calibrating said control variable, which is dependent upon the first signal, in specific operating conditions and in dependence upon the output signal of said one sensor;

said first group of said sensors including means for determining the volume or mass of air drawn into the engine through the intake pipe;

said further sensor being an air mass sensor disposed in said intake pipe; and, said calibration means including means for performing the calibration in quasi-steadystate conditions.

2. The setting system of claim 1, wherein said control variable is especially with respect to the metering of fuel; and, said operating conditions include a reduced fluctuation excursion of the sensor output signals of the first group of sensors influencing the first signal.

3. The setting system of claim 1, wherein a hot film air mass sensor is provided as the further sensor.

4. The setting system of claim 1, wherein the calibration is additionally influenced by the output signal of a fourth sensor.

5. The setting system of claim 4, wherein a lambda probe is provided as fourth sensor.

* * * * *

UNITED STATES PATENT AND TRADEMARK OFFICE

CERTIFICATE OF CORRECTION

PATENT NO. : 5,050,560

DATED : September 24, 1991

INVENTOR(S) : Günther Plapp

It is certified that error appears in the above-identified patent and that said Letters Patent is hereby corrected as shown below:

On the title page, under "Inventor", reference numeral [75]: delete "Güter Plapp" and substitute -- Günther Plapp -- therefor.

In column 1, line 28: delete "how" and substitute -- now -- therefor.

In column 2, line 35: delete "disclosed" and substitute -- discloses -- therefor.

Signed and Sealed this

Fourth Day of May, 1993

*Attest:*

Michael K. Kirk

MICHAEL K. KIRK

*Attesting Officer*

*Acting Commissioner of Patents and Trademarks*